United States Patent [19]

Lindeman

[11] 4,337,540

[45] Jul. 6, 1982

[54] PORTABLE BATHING TUB ACCESSORY FOR SHOWER STALL

[76] Inventor: Patricia A. Lindeman, 7803 Nagle, North Hollywood, Calif. 91605

[21] Appl. No.: 211,918

[22] Filed: Dec. 1, 1980

[51] Int. Cl.[3] ..... A61H 33/02

[52] U.S. Cl. ..... 4/546; 4/556; 4/597; 4/612; 4/641

[58] Field of Search ..... 4/584, 546, 554, 568, 4/556, 567, 590, 596, 597, 612, 615, 639, 640

[56] References Cited

U.S. PATENT DOCUMENTS

| | | | |
|---|---|---|---|
| 1,426,519 | 8/1922 | Swift | 4/568 |
| 1,728,132 | 9/1929 | Norton | 4/590 |
| 2,995,760 | 8/1961 | O'Brien et al. | 4/568 |
| 3,641,596 | 2/1972 | Bill | 4/590 X |
| 3,863,275 | 2/1975 | Brandgord et al. | 4/556 |
| 4,099,272 | 7/1978 | Sowder | 4/590 |
| 4,118,810 | 10/1978 | Brickhouse et al. | 4/556 |

*Primary Examiner*—Henry K. Artis

*Attorney, Agent, or Firm*—Smyth, Pavitt, Siegemund & Martella

[57] ABSTRACT

A portable, lightweight, free-standing tub accessory for use in conventional shower stalls has a generally planar bottom wall and a vertical side wall enclosure extending therefrom to define a container open at the upper end. A panel of the vertical side wall has a cylindrical form and is slidable to provide entry and exit from the container. A drain opening is formed in the bottom and includes means designed to be actuated by the foot of an occupant by sense of feel only, and an adjustable seat may be provided within the tub.

14 Claims, 7 Drawing Figures

PORTABLE BATHING TUB ACCESSORY FOR SHOWER STALL

BACKGROUND OF THE INVENTION

1. Field of the Invention

The invention generally relates to bathing tubs and more particularly relates to a portable bathing tub for use in a conventional shower stall.

2. State of the Prior Art

Portable tubs known in the past include structures such as are disclosed in U.S. Pat. No. 1,426,519 issued Aug. 22, 1922, to Swift disclosing a sit up bathtub with a built in showerhead. This bathtub is fixed in one place by water supply and drain piping. Access is had by stepping over a sidewall portion of reduced height.

U.S. Pat. No. 4,118,810 issued Oct. 10, 1978, to Brickhouse et al. describes a portable chair bathtub which requires connection to water supply and drain conduits.

This unit is designed such that a bather is completely dependent on the assistance of a second person to close and open the door and to actuate the inlet and drain valves. The access door is hinged and is sealed by multiple latches.

U.S. Pat. No. 3,863,275 issued Feb. 4, 1975, to Brendgord et al. teaches a sit up bathtub having a hinged access door with a complex inflatable seal.

None of the above cited references teaches a bathtub accessory for use in a conventional shower stall. The structures are designed for independent use with direct connection to water supply and drain conduits.

Further the hinged access door of the referenced devices renders them unsuitable for use in many conventional shower stalls where the existing stall enclosure may limit or prevent use of such outwardly swinging hinged door. An inwardly swinging hinged access door is equally inappropriate for the relatively small bathtub accessory of this invention because there would not be sufficient spare room to allow the door to swing to a closed position with a person sitting in the tub. Thus the structures shown are not adapted for use within the confined space available in a pre-existing shower stall in that a hinged access door may be obstructed by the stall enclosure, or otherwise be impractical due to existing space limitations.

Significantly, the prior art devices include elaborate, cumbersome and costly means for effecting a leakproof seal between the access door and the sidewall of the tub. Where no access door has been provided, as in the Swift reference, a low sidewall portion must be provided for entrance, the low height of this sidewall portion limiting the depth of the body of water that can be held in the tub.

SUMMARY OF THE INVENTION

Many modern residential units, particularly of the efficiency type lack facilities for taking a bath, but are almost universally equipped with a shower stall since the latter takes up relatively little floor space. As a result, many people are deprived of the pleasure of a hot bath. The therapeutic effects of a hot bath, with or without mineral salts or oils, are particularly desirable for individuals suffering from a variety of ailments.

The present invention overcomes the shortcomings of the prior art by providing a portable, lightweight tub accessory which takes advantage of both the water supply and the drain facilities of an existing, conventional shower stall installation.

The invention of this application comprises a free-standing portable tub of upright configuration having a generally planar bottom wall from which extends a vertical sidewall enclosure defining a container open at the upper end. The dimensions of the container are such as to accommodate a person in sitting position and allowing for some freedom of movement, such as for soaping and scrubbing of the self, but is sufficiently small as to fit in a conventional shower stall. The aperture of the open upper end is sufficiently wide to receive and collect substantially all of a spray such as is ejected by a domestic showerhead to thereby fill the tub with water. The bottom and sidewall of the tub are of watertight, preferably unitary construction and may be manufactured of a plastic material by known molding methods.

Because the tub of this invention is intended for use only in combination with an existing shower stall some leakage of water from the tub poses no difficulties. The water leaking out merely flows down the shower drain in the stall. It is thus possible to construct a tub with an access door of simpler and more economical construction than has been feasible in the past.

Means are provided for opening the drain by sense of feel with the bather's foot, since a tub sufficiently small to be easily carried into a shower stall may be too narrow to permit an adult to bend down and manually operate a drain cover or plug. Absent such means a person could find itself trapped in a water filled tub.

However, even such an eventuality is foreseen and a sliding access door has been provided to allow the door to be at least partially opened even with a full tub as a safety measure, thus discharging the water and allowing exit from the tub. This is a significant improvement over a hinged door arrangement in that water pressure would tend to jam a hinged door in closed position, and even if it could be opened, the pressure would be such that it could not be restrained by the average person in a slightly open position. The door would be pushed wide open and the water discharged from the tub in an instant, flooding the stall at a rate beyond the capacity of the shower drain and very likely overflowing the stall.

At least a portion of the sidewall is of cylindrical form and includes a sliding panel section which serves as an access door into the tub. The bottom of the sliding door slides within a groove or track also of circular curvature and the leading edge of the door fits tightly into a vertical channel formed in the sidewall to form a substantially watertight closure. Vertical strips of resilient material are interposed between the sliding door panel and the sidewall at the leading and trailing vertical edges of the door panel such that the resilient material is pressed against the inner surface of the sidewall by hydrostatic pressure when the tub is filled with water to make a substantially leakproof seal.

A drain opening is formed preferably in the center of the bottom and a cover is pivotally attached to the bottom so that it is movable between a closed position covering the drain opening and an open position partially or fully uncovering the drain opening to discharge the water stored therein. The cover is movable from within the tub and is provided with a foothold projection whereby an occupant of the tub may open or close the cover with a foot and by sense of feel only.

A seat is provided within the tub, the seat being preferably adjustably attached to the sidewall so that an occupant may adjust the spacing of the seat from the bottom of the tub to his particular height and preference. A portion of the wall may be extended vertically to define a backrest for the seat, against which a person may recline while sitting in the tub.

Thus one object of this invention is to provide a portable tub for convenient use in conventional shower stalls.

It is another object of this invention to provide a lightweight portable bathtub for use in a conventional shower stall without modification to the shower stall.

It is a further object of this invention to provide a removable bathtub accessory for shower stalls which does not require any plumbing installation or drain connections.

DETAILED DESCRIPTION OF THE INVENTION

Figure 1:
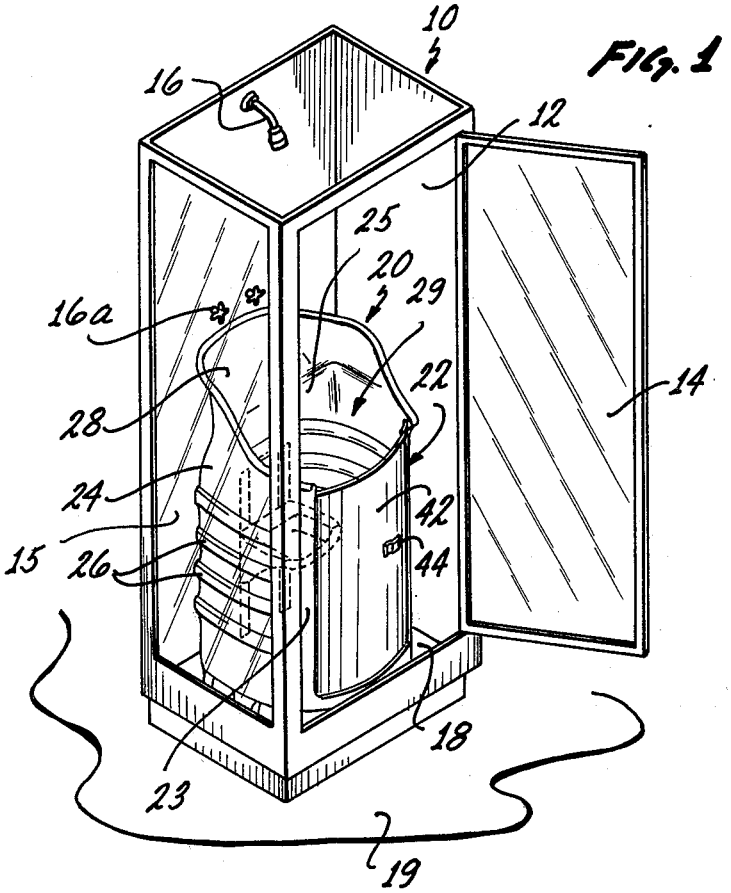
FIG. 1 is a perspective view of the bathtub accessory of this invention installed in a typical shower stall.

With reference to FIG. 1 a shower stall enclosure 10 is shown in an arrangement typical of shower stalls found in most residential units, with a shower head 16 for discharging a water spray within the space 12 enclosed by the stall enclosure 10 and one or more faucets **16*a* to control the flow of water through the shower head 16. A hinged shower stall door 14 opens to admit a person into the stall space 12. The shower stall enclosure 10 also partitions a stall floor 18 of limited area from the main floor 19** of the room wherein the shower stall is located.

The portable bathtub 20 of this invention is shown positioned for use within the shower stall 10.

Figure 2:
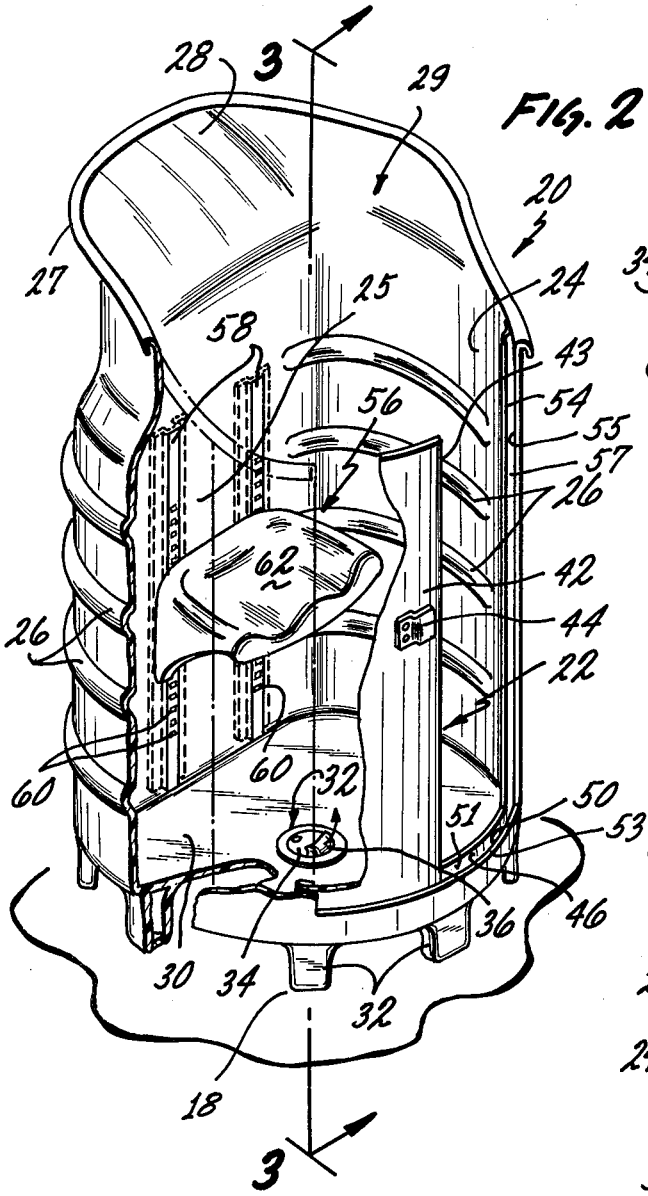
FIG. 2 is a broken away perspective of the tub of this invention.
Figure 5:
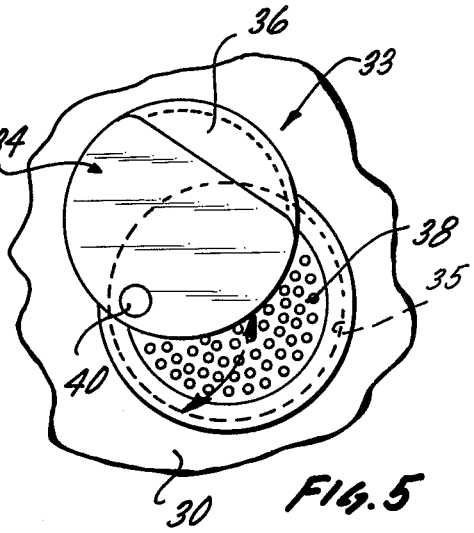
FIG. 5 is a plan view of the drain and pivoting foot operated drain cover.
Figure 4:
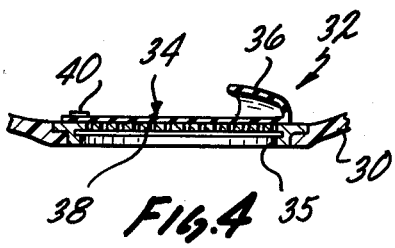
FIG. 4 is an enlarged fragmentary cross-section showing the drain and foot operated drain cover.
Figure 3:
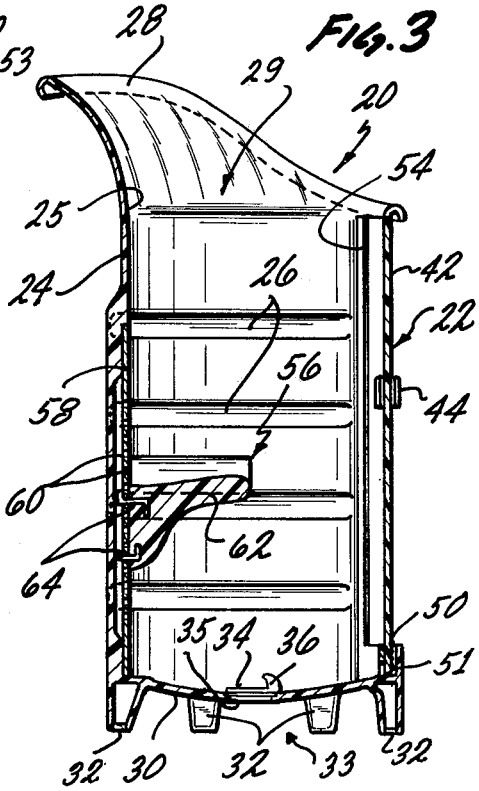
FIG. 3 is an elevational cross-section along the line 3—3 of FIG. 2.

Turning now to FIG. 2 the portable tub 20 is seen to comprise a generally planar bottom wall 30 and a partly cylindrical sidewall 24 closed at the bottom by the bottom wall and terminating in an upper open end 29 preferably bounded by a lip 27. The sidewall 24 may also comprise a generally planar back or rear portion 25 which is extended vertically to provide a back support 28. The sidewall 24 also comprises a cylindrical front portion 23. The open upper end 29 of the tub container is sufficiently wide to receive substantially all of the spray discharged by the shower head 16 within the shower stall enclosure. A drain opening 35 is formed in the bottom wall 30 and has a perforated filter plate 38 inserted therein to prevent objects such as a bar of soap from falling there through. The drain 33 is unconnected to any piping or conduit and as best seen in the cross-section of FIG. 3 discharges the water from the tub directly onto the floor of the shower stall underlying the tub 20.

A drain cover 34 is pivotally mounted as at 40 to the bottom wall 30 and is movable from a closed position over-lying the drain opening to an open position sideways of the drain opening to allow water to be discharged from the tub. A foot-hold such as upwardly curving lip 36 is provided on the drain cover 34 preferably at the point opposite the pivot mount 40 such that a person using the tub may be sense of feel locate this foot-hold and move the drain cover to a desired position, closed or open or some intermediate position. An intermediate position may be desired, for example, to allow a steady, limited drain outflow while the shower spray is allowed to run to continuously replenish the outflow, to thereby maintain a hot bath over a prolonged period of time.

Figure 7:
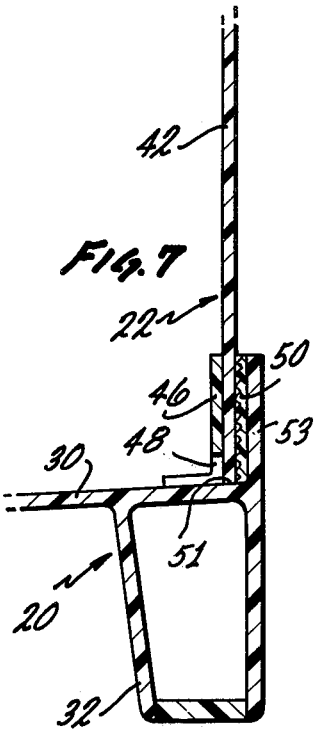
FIG. 7 is a fragmentary elevational cross-section taken along the line 7—7 in FIG. 6.
Figure 6:
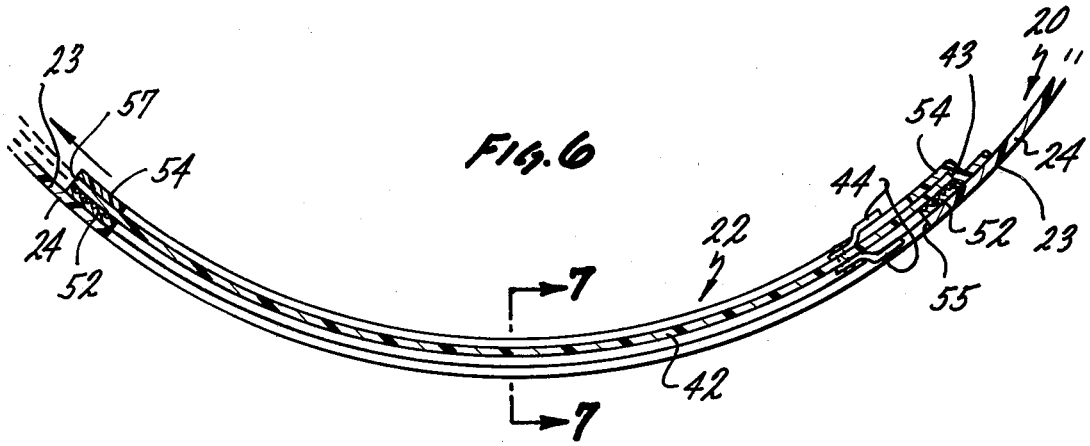
FIG. 6 is a horizontal fragmentary cross-section of the tub showing the sliding door panel and adjacent sidewall portions.

The tub sidewall 24 comprises a generally planar rear portion 25 such that it may be positioned adjacent to one of the walls 15 of the shower stall as shown in FIG. 1. The frontal portion 23 of the tub sidewall 24 is of cylindrical form with a substantially uniform radius of curvature. A door panel 42 formed of a section of the cylindrical portion of the sidewall is mounted within a channel 51 defined between a radial inner vertical flange 46 and a lower portion 50 of the sidewall 24. The panel 42 is mounted within the channel 51 for sliding movement along the inner surface of the sidewall 24 along an arc of circle to provide an access door 22 into the tub enclosure. In closed position the leading edge 43 of the sliding panel fits within a vertical groove or channel 57 defined between a vertical flange 54 and the vertical edge 55 of the sidewall. The trailing edge 57 of the door panel 42 is supported in upright position against the inner surface of the sidewall 24 by a vertical strip 54 (shown in FIG. 6) secured to the bottom 30 as well as at the top end of the sidewall 24 to define a vertical slit with the sidewall through which the door slides. In closed position the door panel 42 is thus supported along the bottom edge as well as along the two vertical edges. Strips of resilient sealing material are provided between the door panel 42 and the inner surfaces of the sidewall within the bottom channel 51, in the vertical channel 55 accommodating the leading edge of the door panel, and in the vertical slit defined between the sidewall and the vertical strip 54. The seal strips are of a resilient material such as rubber and preferably have longitudinal serrations or ridges running parallel to the edges of the sidewall. As shown in FIG. 7 a seal strip 50 is interposed between the lower horizontal flange 53 and the outer surface of the door panel 42. The cross-section of FIG. 6 shows the vertically extending seal strips 52 and 52' adjacent the leading and trailing edges 43, 57 of the door panel 42 respectively. A seat 56 is attached to the rear planar portion 25 of the sidewall by means of a pair of hooks 64 fitting into vertically aligned complimentary recesses 60 whereby the seat may be attached to the sidewall at a selected distance from the bottom 30. The seat 56 may be provided with a contured surface 62 for greater comfort. The rear portion of the sidewall 25 is provided with a vertically extended portion 28 which defines a back or head rest for the seat 56. This extended portion 28 may be curved outwardly and rearwardly from the tub to form an inclined surface such that a person may lean back and rest against it.

The tub 20 is preferably provided with a plurality of radial ribs 26 embracing the sides of the tub to increase the rigidity of the sidewall against the hydrostatic pressure of the water filling the same. In one embodiment the door panel 42 may be provided with similar horizontally extending ribs to increase the rigidity of the door as well. The vertical strip 54 would then be contoured to accommodate the ribbing and provide space for sliding the same through the vertical slit defined thereby.

The bottom 30 of the tub is spaced from the shower stall floor 18 by a plurality of legs 32 which may be of hollow construction. The legs 32 serve to reduce heat loss from the tub to the stall floor and thus retain the heat of the water. In addition the legs 32 space the bottom from the underlying floor to allow the unimpeded discharge of water from the tub onto the underlying floor and into the drain of the shower stall.

The sliding door panel 42 is pushed outwardly against the edges of the ridged seal strips by the internal pressure of the water filling the tub to effect a substantially water tight seal. It will be appreciated that some leakage is easily tolerated since any water escaping from the tub would be contained within the shower stall and would flow down the shower stall drain, causing no inconvenience. Because of this it is possible to construct a simple and inexpensive tub accessory for a shower stall. As a further precaution against leakage an opening 48 is formed near the bottom of the internal flange 46 to allow water to flow back into the tub from the bottom channel 51.

The tub unit 20 of this invention may be formed by molding methods and fashioned out of thermo plastic material. The resulting tub is durable and of relative lightweight.

What is claimed is:

1. A portable bathtub accessory for use in a shower stall of the type having a shower head for spraying water and a drain for draining the water from the floor of the stall comprising in combination:

a free standing tub having a bottom and sidewall means defining an open top for receiving substantially all of said water spray, said tub being of sufficient width to permit a person to sit therein;

an access door in said sidewall means;

drain means for discharging water from said tub directly onto the underlying stall floor surface;

means operable from within said tub for opening and closing said drain means;

and, a seat provided within said tub.

2. The portable tub of claim 1 wherein said seat is removable.

3. The portable tub of claim 1 wherein said seat is affixed to said sidewall means, such that said seat may be adjusted to a selected distance from said bottom.

4. The portable tub of claim 1 further comprising a portion of said sidewall of extended height defining a back rest for a person sitting in said seat.

5. The portable tub of claim 1 wherein said sidewall means comprises a planar back portion and a cylindrical front portion and said access door comprises a slideable section of said cylindrical sidewall portion.

6. The portable tub of claim 5 wherein said slideable section is moveable within curved channel means formed in said bottom and further comprising seal means interposed between said sidewall and said sliding section whereby when said tub is filled with water said sliding section is urged by hydrostatic pressure against said sidewall portion, said seal means providing a seal against substantial leakage of water from said tub.

7. The portable tub of claim 1 wherein said drain means comprises an opening formed in said bottom and said means for closing comprises a cover moveable between a closed position covering said opening and an open position said cover including a foothold whereby said cover may be moved by a person's foot while said tub is filled with water.

8. The portable tub of claim 7 wherein said means for closing is a cover pivotally mounted to said bottom.

9. The portable tub of claim 1 further comprising means for spacing said bottom from an underlying floor surface to permit the unimpeded discharge of fluid from said tub into a drain located beneath said bottom and for reducing thermal contact with said floor surface.

10. The portable tub of claim 1 wherein said seat is attached to said sidewall means opposite said access door.

11. The portable tub of claim 1 wherein said seat is provided with hook members engageable in selected ones of a plurality of complimentary recesses formed in said sidewall means.

12. The portable bathtub of claim 1 wherein said bottom and said sidewall means are unitarily molded from a plastic material.

13. A portable bathtub accessory for use in an existing shower stall of the type having a shower for spraying water and a drain for draining the water comprising in combination;

a free standing tub having a bottom, sidewall means, and an open upper end for receiving substantially all of the water spray from said shower head, said sidewall means having a generally planar back portion and a cylindrical front portion, said tub being of sufficient width to permit a person to sit therein;

an access door comprising a portion of said cylindrical sidewall portion, said access door being slideable along the interior of said sidewall and being provided with resilient seal means whereby said access door is held in substantially sealing engagement with said sidewall by hydrostatic pressure when said tub is filled with water;

drain means formed in said bottom for discharging water from said tub directly onto an underlying floor surface;

leg means attached to said bottom for spacing said bottom from said floor surface to permit the unimpeded flow of said discharged water into said drain;

means operable from within said tub for opening and closing said drain means; and a seat provided within said tub.

14. The portable bathtub of claims 1 and 13 wherein said means for opening and closing said drain means are operable by sense of feel with a person's foot.

* * * * *